United States Patent [19]

Middelhoek et al.

[11] 4,049,425

[45] Sept. 20, 1977

[54] PROCESS FOR THE MANUFACTURE OF ALUMINUM

[75] Inventors: Servaas Middelhoek; Gerhardus Santing, both of Arnhem; Nicolaas Dost, Bennekom, all of Netherlands

[73] Assignee: Shell Oil Company, Houston, Tex.

[21] Appl. No.: 667,046

[22] Filed: Mar. 15, 1976

[30] Foreign Application Priority Data

Mar. 21, 1975 Netherlands ..... 7503385

[51] Int. Cl.[2] ..... C22C 1/02

[52] U.S. Cl. ..... 75/135; 75/68 A; 75/68 R

[58] Field of Search ..... 75/68 R, 68 A, 135

[56] References Cited

U.S. PATENT DOCUMENTS 3,685,984 8/1972 Layne ..... 75/68 R

*Primary Examiner*—Peter D. Rosenberg

[57] ABSTRACT

An improved process for the manufacture of aluminum by reducing aluminum/oxygen compounds with carbon at high temperatures is described.

8 Claims, No Drawings

PROCESS FOR THE MANUFACTURE OF ALUMINUM

BACKGROUND OF THE INVENTION

The reduction of alumina and aluminum hydroxide and their hydrates (oxidic aluminum) with carbon (carbothermic reduction) was known long before the currently used electrolytic reduction method was introduced. Initially, the carbothermic reduction of bauxite or pure aluminum oxide produced little or no metallic aluminum. The presence of aluminum carbide was shown and when the carbothermic reduction of bauxite was effected at 2000° C and 1 atmosphere (atm) air pressure, large losses were caused by vaporization. In order to overcome this problem Cowles added iron, copper or nickel to the bauxite/carbon mixture to prevent the formation of aluminum carbide (American Journal of Science 3, (1885), 308). At 2000° C and 1 atm air pressure, aluminum alloys were obtained. Later, it was shown that aluminum could be successfully distilled in vacuo from the aluminum alloys at 1500° C (French Pat. No. 474,375).

The process of this invention improves the yield of aluminum at lower temperatures.

SUMMARY OF THE INVENTION

The invention is a process for the manufacture of aluminum and/or aluminum alloys which comprises contacting an oxidic aluminum containing material with carbon in the presence of iron, cobalt or nickel at a temperature between 1000° C and 1950° C at a subatmospheric pressure.

DESCRIPTION OF THE PREFERRED EMBODIMENTS

The invention relates to a process for the manufacture of aluminum and/or aluminum alloys by reducing an oxidic aluminum-containing material at high temperature with carbon, characterized in that iron, cobalt or nickel is also present in the reaction mixture and the reduction proceeds at a temperature less than 2000° C. The preferred range of temperature is between 1000° and 1950° C, particularly preferred is between 1100° C and 1700° C and most preferred is between 1200° C and 1600° C.

The amount of iron, nickel or cobalt or mixtures thereof added to the mixture of oxidic aluminum-containing material and carbon is preferably at least 1/6 of the quantity by weight of oxidic aluminum-containing material. The preferred weight ratio of iron nickel or cobalt to oxidic aluminum-containing material is between 1/6 and 1/2, particularly between 1/6 and 1/3 and most particularly between 1/6 and 1/4.

Nickel and cobalt are the preferred metals of the three mentioned above and the most preferred is cobalt. While the metals may be used singularly, mixtures of the metals are also very effective.

A preferred method of practicing the process of this invention is to carry out the process at subatmospheric pressures.

Pressures in the range of from $10^{-3}$ to $10^{2}$ milliliters (mm) Hg are preferred and from $10^{-2}$ to $5^{0}$ mmHg are most preferred. The reduced pressures help remove carbon monoxide. Additional help can be achieved by passing an inert gas over the reaction mixture during the process.

The oxidic aluminum are typically any of the oxides, hydrated oxides, silicated oxides and hydroxides of aluminum.

Bauxite is used as oxidic aluminum-containing material. The main component of the crude material is gibbsite ($Al_2O_3.3H_2O$), in addition to kaolinite ($Al_2O_3.2SiO_2.2H_2O$), boehmite ($Al_2O_3.H_2O$), $Fe_2O_3$ (11.9%), $TiO_2$ (2.0%) and $SiO_2$ (0.4%). Of course, pure $Al_2O_3$ may also be used.

The carbon can be added as charcoal, graphite, coke, carbon black and coal. The preferred form is charcoal or graphite.

The following Illustrative Embodiments are provided to illustrate the invention only and no limitation on the scope of the invention is implied.

ILLUSTRATIVE EMBODIMENT I

In order to find out whether the liquid metal-carbon (C) phase might play a role, Fe, Ni, Co, Cr and Cu were added to the mixture of alumina ($Al_2O_3$) and carbon and heated at 1450° C and 2.5 Torr. After the reaction it was found that if Fe, Ni or Co had been added, the proportion of alumina reduced was respectively 65, 60, and 72%. Hardly any reduction was found to have taken place when chromium or copper had been used. This is probably connected with the fact that carbon-containing chromium is solid at 1450° C and that copper does not dissolve any carbon at 1450° C. The following Table I states the melting points of the metals, the eutectic temperature of metal-carbon mixture, and the proportion of carbon dissolved.

Table I

| Metal | Melting point, ° C | Metal-carbon eutectic temperature in ° C | Dissolved % by wt of carbon at eutectic temp. |
|---|---|---|---|
| Fe | 1535 | 1150 | 4.3 |
| Ni | 1453 | 1318 | 2.2 |
| Cr | 1890 | 1500 | 3.5 |
| Cu | 1083 | — | —[x] |
| Co | 1495 | 1319 | 2.9 |

[x]solubility of carbon below 1500° C is less than 0.0005% by wt.

On the basis of the above data we conclude that at the reaction temperature of 1450° C the carbon atoms are transferred to the oxygen atoms via the dissolved liquid phase, and that carbon dissolves in the iron, nickel or cobalt in a reasonable quantity and at a reasonable rate.

Another interesting aspect of the process is that the yield of aluminum (in the form of an alloy) is sometimes as high as 90% by weight, based on the original quantity of aluminum bound in bauxite. Sublimation products ($\alpha$ $Al_2O_3$, $Al_4O_4C$ and C) formed by reaction of aluminum or aluminum suboxide and the formed CO, are deposited on the walls of the reactor.

ILLUSTRATIVE EMBODIMENT II

The effect of the iron powder in the bauxite/C/Fe mixtures was investigated at 1450° C and 2.5 Torr. Carbon was invariably present in stoichiometric quantities. As the quantity of iron increases, so the quantities of sublimation products decrease, as Table II shows:

TABLE II

| $Fe:FeAl_3$[x] | Sublimation losses in % by wt based on $Al_2O_3$ used | Metallic fraction of the residue, in % by wt | Atom % Al in Fe |
|---|---|---|---|
| 1.2 | 16.4 | 69 | 68 |
| 2 | 7.2 | 100 | 64 |
| 3 | 2.6 | 100 | 58 |

TABLE II-continued

| Fe:FeAl$_3$[x] | Sublimation losses in % by wt based on $Al_2O_3$ used | Metallic fraction of the residue, in % by wt | Atom % Al in Fe |
|---|---|---|---|
| 4 | 0.8 | 100 | 44 |

[x]Fe:FeAl$_3$ = 1 means that the starting mixture contains just enough Fe to form FeAl$_3$ if no evaporation of aluminum took place.

ILLUSTRATIVE EMBODIMENT III

Bauxite was ground into particles ≦100μ. The bauxite had the following composition:

| | |
|---|---|
| gibbsite, $Al_2O_3.3H_2O$ | 79.4% by wt. |
| kaolinite, $Al_2O_3.2SiO_2.2H_2O$ | 5.4% by wt. |
| boehmite, $Al_2O_3.H_2O$ | 0.78% by wt. |
| $Fe_2O_3$ | 11.9% by wt. |
| $SiO_2$ | 2.0% by wt. |

The loss of weight on heating to 1100° C is 29.5% by weight.

The bauxite was mixed with graphite powder and iron powder of the desired particle size in a universal mixer. The resultant mixture was then compressed into tablets in a hydraulic press at a pressure of 1000 Kg/cm². Each tablet weighed approximately 1g. Instead of compressed tablets, in a number of tests a solution was prepared of the reaction mixture in water with 1% by weight of gum arabic, after which the water was evaporated and the cake cut into pieces of 1 cm². The reaction mixture (approx. 30g) was placed in a sillimanite tube and heated in a vacuum furnace. The furnace was evacuated to 0.2 Torr, after which the mixture was heated to 620° C in one hour. In the following 45 minutes it was further heated to the requisite temperature of 1450° C. Subsequently the pressure was maintained at 2.5 Torr. The temperature and pressure were then held constant for 1.5 hours, after which the mixture was slowly cooled in the furnace. Several reaction products were obtained: a bottom residue and sublimation product, the latter consisting of α $Al_2O_3$, $Al_4O_4C$ and free carbon. The bottom product consists of a metallic lump or of little tablets which are entirely or partly metallic. If the tablets have not been fully converted, the metallic part can be visually distinguished from the partly converted starting material (residue). Sublimation products and bottom products are subjected to X-ray examination and chemical analysis. Table III shows the starting materials and the reaction conditions, Table IV the chemical analysis results and the results of the X-ray examination.

TABLE III

| | Starting materials and reaction conditions | | | | |
|---|---|---|---|---|---|
| No. TK | Fe particle size,μ | Total tablet weight, g | Bauxite content g | $Al_2O_3$-content g | C-content g |
| 006 | 45 <d <90 | 26.30 | 18.85 | 10.30 | 4.61 |
| 007 | " | 30.80 | 19.75 | 10.78 | 4.72 |
| 008 | " | 34.70 | 19.75 | 10.78 | 4.72 |
| 009 | " | 31.22 | 15.94 | 8.72 | 3.82 |
| 010 | <32 | 25.88 | 19.10 | 10.43 | 4.54 |
| 011 | >90 | 25.17 | 18.57 | 10.14 | 4.42 |
| 012 | <32 | 30.89 | 19.90 | 10.86 | 4.73 |
| 013 | >90 | 30.90 | 19.90 | 10.86 | 4.73 |
| 019 | <32 | 29.53 | 18.65 | 10.20 | 4.42 |
| 020 | <32 | 29.86 | 19.24 | 10.50 | 4.56 |
| 021 | >90 | 29.29 | 18.86 | 10.30 | 4.48 |
| 022 | <32 | 27.58 | 19.75 | 10.78 | 4.72 |
| 023 | <32 | 29.31 | 19.83 | 10.83 | 4.73 |
| 025 | <32 | 25.52 | 16.45 | 8.98 | 3.90 |

TABLE III-continued

| | | | | | |
|---|---|---|---|---|---|
| 026 | <32 | 28.65 | 17.52 | 9.57 | 4.16 |

| Fe[1] Total, g | Fe[2] tot. Fe th. | Pressure mm Hg | React. temp. °C | Sublim. prod. g | Remarks |
|---|---|---|---|---|---|
| 4.40 | 1.2 | 2.5 | 1450 | 1.69 | Tablet |
| 7.90 | 2.0 | 2.5 | 1450 | 0.83 | " |
| 11.97 | 3.0 | 2.5 | 1450 | 0.28 | " |
| 12.78 | 4.0 | 2.5 | 1450 | 0.07 | " |
| 3.83 | 1.0 | 2.5 | 1450 | 0.15 | " |
| 3.71 | 1.0 | 2.5 | 1450 | 0.06 | " |
| 7.91 | 2.0 | 2.5 | 1450 | 0.36 | " |
| 7.91 | 2.0 | 2.5 | 1450 | 0.57 | " |
| 7.45 | 2.0 | 2.5 | 1450 | 0.93 | " |
| 7.66 | 2.0 | 2.5 | 1450 | 0.91 | Tablet (3000 kg/cm²) |
| 7.51 | 2.0 | 2.5 | 1450 | 0.75 | Tablet (3000 kg/cm²) |
| 4.75 | 1.2 | 2.5 | 1475 | 2.80 | Tablet |
| 6.38 | 1.6 | 2.5 | 1450 | 1.63 | " |
| 6.54 | 2.0 | 2.5 | 1450 | 0.44 | Piece of Cake |
| 7.06 | 2.0 | 2.5 | 1450 | <0.01 | " + 1.36 g $B_2O_3$ |

| | Starting materials and reaction conditions | | | | |
|---|---|---|---|---|---|
| No. TK | Fe particle size,μ | Total tablet weight, g | Bauxite content g | $Al_2O_3$-content g | C-content g |
| 027 | <32 | 33.32 | 17.76 | 9.70 | 4.23 |
| 028 | <32 | 28.26 | 18.20 | 9.94 | 4.32 |
| 029 | — | 34.05 | 18.83 | 10.28 | 6.17 |
| 031 | <32 | 25.53 | 17.31 | 9.45 | 4.12 |
| 033 | <32 | 24.46 | 17.04 | 9.30 | 4.06 |
| 034 | <32 | 24.74 | 18.26 | 9.97 | 4.34 |
| 035 | <32 | 28.30 | 18.20 | 9.94 | 4.33 |
| 036 | >90 | 27.34 | 17.59 | 9.60 | 4.19 |
| 037 | >90 | 28.42 | 18.28 | 9.98 | 4.35 |
| 038 | <32 | 28.69 | 18.45 | 10.07 | 4.39 |
| 039 | >90 | 28.75 | 18.49 | 10.10 | 4.40 |
| 040 | <32 | 19.68 | 12.66 | 6.91 | 3.01 |

| Fe[1] Total, g | Fe[2] tot. Fe th. | Pressure mm Hg | React. temp. °C | Sublim. prod. g | Remarks |
|---|---|---|---|---|---|
| 7.10 | 2.0 | 2.5 | 1450 | <0.01 | Piece of cake + 5.7 g MgO |
| 7.25 | 2.0 | 0.2 | 1350 | 0.06 | Piece of cake |
| 7.52 | 2.0 | 2.5 | 1475 | 1.44 | " instead of Fe $Fe_2O_3$ |
| 5.54 | 1.6 | 2.5 | 1450 | 0.70 | Tablet |
| 4.77 | 1.4 | 2.5 | 1450 | 1.14 | " |
| 3.66 | 1.0 | 2.5 | 1500 | 4.21 | " |
| 7.28 | 2.0 | 2.5 | 1500 | 2.24 | " |
| 7.03 | 2.0 | 0.3 | 1400 | 1.51 | " |
| 7.31 | 2.0 | 0.2 | 1375 | 0.53 | " |
| 7.38 | 2.0 | 0.2 | 1375 | 0.70 | " |
| 4.52 | 1.2 | 2.5 | 1450 | 1.02 | " instead of Fe 5.86 g FeAl |
| 3.09 | 1.2 | 2.5 | 1450 | 0.25 | " instead of Fe 4.01 g FeAl |

Footnotes: [1]Fe total = added Fe powder + Fe produced by reduction of $Fe_2O_3$ in the bauxite.
[2]Fe total/Fe theoretical = Fe present/Fe required for FeAl$_3$ if sublimation losses do not occur.

TABLE IV

| | | X-ray diffraction analysis[5] | | | | |
|---|---|---|---|---|---|---|
| No. | Bottom product | Weight g | $Fe_2Al_5$ | FeAl | $Fe_3Al$ | $\alpha Al_2O_3$ |
| 006 | metallic | 6.48 | + | ++ | | |
| | residue | 2.94 | + | ++ | | |
| 007 | metallic | 14.55 | | ++ | | +⁻ |
| 008 | metallic | 19.05 | | ++ | | +⁻ |
| 009 | metallic | 18.35 | | ++ | | |
| 010 | metallic | 0.64 | | | ++ | + |
| | residue | 12.16 | | | ++ | ++ |
| 011 | residue | 14.84 | | | ++ | ++ |
| 012 | metallic | 12.26 | | ++ | | +⁻ |
| | residue | 3.38 | | | ++ | + |
| 013 | metallic | 14.76 | | ++ | | +⁻ |
| 019 | metallic | 13.42 | | ++ | | ~ |
| 020 | metallic | 13.89 | | ++ | | +⁻ |
| | residue | 0.73 | | ++ | | ~ |
| 021 | metallic | 13.83 | | ++ | | + |

TABLE IV-continued

| | | | Chemical analysis[4] | | | | |
|---|---|---|---|---|---|---|---|
| $Al_4O_4C$ | $Al_4C_3$ | unknown | 2 Al %by wt | 3 $Al_2O_3$ %by wt | Fe %by wt | Si %by wt | Ti %by wt |
| | | | 46.5 | | 45.0 | 6.7 | 1.9 |
| +⁻ | ~ | | 59.8 | | 36.8 | 2.6 | 1.7 |
| | | | 44.4 | | 51.5 | 2.9 | 1.2 |
| | ~ | | 39.0 | | 59.3 | 1.0 | 1.2 |
| | | | 26.2 | | 69.8 | 2.3 | 0.8 |
| | +⁻ | | 33.7 | | 48.1 | 7.4 | 2.7 |
| +⁻ | +⁻ | | 40.8 | | 26.6 | 3.6 | 1.6 |
| | +⁻ | | 38.5 | | 24.2 | 2.2 | 1.2 |
| | +⁻ | | 36.6 | | 50.5 | 3.2 | 1.3 |
| | +⁻ | | 38.5 | | 37.7 | 2.3 | 1.6 |
| | +⁻ | | 38.4 | | 51.8 | 3.3 | 1.6 |
| | ~ | | 33.8 | | 50.5 | 4.4 | 1.5 |
| +⁻ | +⁻ | | 33.5 | | 50.0 | 4.0 | 1.5 |
| | ~ | | | | | | |
| | +⁺ | | 31.1 | | 50.5 | 3.9 | 1.4 |

| | | X-ray diffraction analysis[5] | | | | |
|---|---|---|---|---|---|---|
| No. | Bottom product | Weight g | $Fe_2Al_5$ | FeAl | $Fe_3Al$ | $\alpha Al_2O_3$ |
| 022 | metallic | 9.22 | ++ | | | |
| 023 | metallic | 12.02 | + | ++ | | |
| 025 | metallic | 10.77 | | ++ | | + |
| | residue | 0.60 | | ++ | | + |
| 026 | metallic | 1.86 | | ++ | | +⁻ |
| | residue | 13.02 | | | ++ | ++ |
| 027 | metallic | 0.10 | | | ++ | +⁻ |
| | residue | 14.58 | | | ++ | +⁻ |
| 028 | metallic | 0.12 | | | ++ | +⁻ |
| | residue | 16.26 | | | ++ | + |
| 029 | metallic | 13.11 | + | ++ | | |
| 031 | metallic | 7.05 | | ++ | | +⁻ |
| | residue | 4.42 | | +⁻ | ++ | + |
| 033 | metallic | 8.88 | | ++ | | +⁻ |
| | residue | 0.85 | + | ++ | | ~ |

| | | | Chemical Analysis[4] | | | | |
|---|---|---|---|---|---|---|---|
| $Al_4O_4C$ | $Al_4C_3$ | unknown | 2 Al %by wt | 3 $Al_2O_3$ %by wt | Fe %by wt | Si %by wt | Ti %by wt |
| | | | 37.5 | 4.3 | 46.5 | 7.1 | 2.3 |
| | | | 34.5 | 4.9 | 47.5 | 5.2 | 1.7 |
| | +⁻ | | 24.0 | 14.4 | 51.0 | 3.6 | 1.4 |
| | +⁻ | | 18.0 | 26.4 | 36.5 | 2.8 | 1.7 |
| | | | 20.0 | 12.5 | 54.0 | 3.5 | 1.6 |
| | | | 11.0 | 25.5 | 61.5 | 2.4 | 1.0 |
| | | | 11.5 | 22.3 | 42.0 | 5.0 | 1.3 |
| | | | 17.0 | 17.0 | 49.0 | 5.7 | 2.9 |
| | | | 13.0 | 25.5 | 43.5 | 2.4 | 1.1 |
| | | | 32.5 | 2.6 | 52.5 | 7.1 | 1.4 |
| | +⁻ | | 28.5 | 7.4 | 50.0 | 4.6 | 1.3 |
| +⁻ | +⁻ | | 27.0 | 16.1 | 33.0 | 2.9 | 1.7 |
| +⁻ | +⁻ | | 32.5 | 7.2 | 44.0 | 5.5 | 1.7 |
| | | +⁻¹ | 31.0 | 6.6 | 34.0 | 4.0 | 1.5 |

| | | X-ray diffraction analysis[5] | | | | |
|---|---|---|---|---|---|---|
| | Bottom | Weight | | | | |

TABLE IV-continued

| No. | product | g | $Fe_2Al_5$ | FeAl | $Fe_3Al$ | $\alpha Al_2O_3$ |
|---|---|---|---|---|---|---|
| 034 | metallic | 6.64 | ++ | | | ~ |
| 035 | metallic | 11.98 | | ++ | | ~ |
| 036 | metallic | 12.58 | | ++ | | ~ |
| 037 | metallic | 12.68 | | | ++ | + |
| | residue | 0.87 | | | ++ | + |
| 038 | metallic | 10.61 | | | ++ | + |
| | residue | 1.32 | | | ++ | + |
| 039 | residue | 16.95 | | | ++ | + |
| 040 | residue | 12.57 | | | ++ | + |

| | | | Chemical analysis[4] | | | | |
|---|---|---|---|---|---|---|---|
| $Al_4O_4C$ | $Al_4C_3$ | unknown | 2 Al %by wt | 3 $Al_2O_3$ %by wt | Fe %by wt | Si %by wt | Ti %by wt |
| | | +⁻¹ | 34.0 | 2.3 | 49.0 | 9.0 | 2.9 |
| | | | 26.5 | 8.3 | 56.0 | 6.1 | 1.8 |
| | | | 28.0 | 7.9 | 51.5 | 4.5 | 1.2 |
| | +⁻ | | 22.5 | 14.9 | 50.5 | 3.4 | 1.1 |
| | +⁻ | | 7.9 | 37.8 | 18.5 | 1.1 | 1.8 |
| | | | 23.0 | 14.7 | 49.5 | 3.3 | 1.2 |
| | +⁻ | | 18.0 | 24.6 | 36.5 | 5.1 | 1.2 |
| + | +⁻ | | 27.0 | 15.5 | 23.5 | 3.8 | 1.4 |
| + | | | 20.0 | 25.5 | 22.0 | 3.5 | 1.5 |

[1]This compound is probably $Fe_3AlC_x$.

[2,3]The aluminum content of samples 006 - 021 inclusive corresponds with the total aluminum content. From 022 on a distinction was made between the acid-soluble (HCl) Al-content in the iron-aluminum compounds, $Al_4O_4C$, $Al_4C_3$ and the acid-insoluble $\alpha$ $Al_2O_3$.

[4]Accuracy of the analyses: 10% relative for Si and Ti± 0.5% absolute for Al and Fe.

[5]++ means main product (30-100)%; + means by-product (10-30)%; + means side (3-10)%; ~ means trace (1-3)%.

We claim as our invention:

1. In the process for the manufacture of aluminum alloys by reducing an oxidic aluminum-containing material at high temperature with carbon, the improvement which comprises carrying out the reduction in the presence of a catalyst metal selected from the group consisting of iron, nickel, cobalt a mixture thereof at a temperature between 1000° C and 1950° C.

2. The process of claim 1 where the temperature is between 1100° C and 1700° C.

3. The process of claim 2 where the temperature is between 1200° C and 1600° C.

4. The process of claim 3 where the ratio of catalyst metal to oxidic aluminum compound is at least 1:6.

5. The process of claim 4 where the metal is iron.

6. The process of claim 4 where the metal is cobalt.

7. The process of claim 4 where a pressure of $10^{-3}$ to $10^{2}$ mmHg is maintained during the reduction.

8. The process of claim 8 where the oxidic aluminum-containing material is bauxite.

* * * * *